United States Patent [19]

Rossignol de la Ronde et al.

[11] 4,088,413

[45] May 9, 1978

[54] ARTISTS BRUSHES

[75] Inventors: Raymond René Rossignol de la Ronde, Paris; Charles Henri Castek, Pordic, both of France

[73] Assignee: La Brosse et Dupont, Paris, France

[21] Appl. No.: 660,135

[22] Filed: Feb. 23, 1976

[51] Int. Cl.[2] ..... A46B 11/04; A47L 13/22

[52] U.S. Cl. ..... 401/282; 15/159 A; 15/DIG. 5

[58] Field of Search ..... 401/282, 283, 268, 269, 401/272; 15/104 R, 159 R, 159 A, DIG. 5, DIG. 6, 106, 166, 192, 193, 160, 204

[56] References Cited

U.S. PATENT DOCUMENTS

| | | | |
|---|---|---|---|
| 2,786,222 | 3/1957 | Rolker | 15/193 |
| 3,924,287 | 12/1975 | Brown | 15/159 A X |
| 3,964,122 | 6/1976 | Kurdy | 15/184 |

FOREIGN PATENT DOCUMENTS

| | | | |
|---|---|---|---|
| 554,826 | 3/1958 | Canada | 15/159 R |
| 723,023 | 2/1955 | United Kingdom | 15/159 R |

*Primary Examiner*—Stephen C. Pellegrino
*Attorney, Agent, or Firm*—Christel & Bean

[57] ABSTRACT

A liner brush having a central and a peripheral tuft of hairs. The central tuft projects beyond the peripheral tuft and has a cross sectional area, perpendicular to the length of the brush, which is substantially less than that of the peripheral tuft. Consequently, only the central tuft is used for drawing thin lines, whereas the peripheral tuft serves as a reservoir storing the material to be applied.

3 Claims, 3 Drawing Figures

ARTISTS BRUSHES

This invention relates to liner brushes suitable for the drawing of lines having a width between 4 millimeters and 0.2 millimeters, for example; such brushes may be used to decorate china, for example.

Round brushes are known which comprise a tuft of hairs, mounted on a handle by means of a ferrule and having a substantially conical end. The quantity of material to be applied (paint or ink for example) which is stored in the brush at each dipping into this material evidently depends on the volume of the tuft of hairs: a brush with a wide tuft stores more material to be applied than a brush with a narrow tuft. As the width of a line which can be drawn with a brush also depends on the volume of this tuft, it is clear that a brush intented to draw relatively fine lines can store only a little of the material to be applied. Consequently, anyone using such a brush must interrupt his work frequently to recharge it by dipping it into this material.

U.S. Pat. No. 3,633,234 to Henningsen and German DOS No. 1,808,788 to Sauer disclosed two types of reservoir brushes for the coating of large surfaces; these are flat brushes, or round brushes with a tuft of hairs of very large cross section; these brushes are provided with complex and cumbersome devices to store a large enough quantity of paint; these cumbersome store devices cannot possibly be adapted to a liner brush, of which the tuft of hairs must have a relatively small cross section, at least near the drawing point.

French Pat. No. 1,230,594 to Lorenzetti also disclosed a brush for house painting, particularly intented for recoating work, which even in its unused state comprises long bristles constituting the working part or the point and short bristles, supporting the long bristles and serving to provide the reserve of paint. By reason of its intented use, this known brush comprises a central tuft of bristles, the cross section of which has an area much greater than the area of the cross section of the peripheral tuft, which completely prevents its use as a brush for drawing fine lines.

A first object of the present invention is to provide a liner brush having a central tuft of hairs surrounded by a peripheral tuft of hairs, the hairs of the central tuft projecting beyond the hairs of the peripheral tuft, and the central tuft having a cross section, perpendicular to the length of the brush, which is substantially less than that of the tuft of peripheral hairs.

It is clear that the peripheral tuft of the brush according to the present invention serves as a reservoir, storing the material to be applied, for the central tuft which is constituted by fine hairs to enable the drawing of fine lines. The recharging of a brush embodying the invention with the material to be applied can thus take place at longer intervals.

Another object of the present invention is to provide a first method of making a brush embodying the invention: in this first method, before the final fixing of a tuft of hairs, all of the same length, in a ferrule, the hairs located towards the centre of this tuft are drawn outwards so that they project substantially beyond the peripheral hairs of the original tuft.

Still another object of the present invention is to provide a second method of making a brush embodying the invention: in this second method a composite tuft of fine hairs, comprising central hairs having a length substantially greater than that of the peripheral hairs of the tuft, is fixed in a ferrule.

According to another feature of the present invention the hairs of the central and peripheral tufts may have different characteristics, for example they may be of different materials or have different stiffness. This is particularly advantageous when the central hairs are longer than the peripheral hairs.

In a preferred embodiment of the present invention the hairs constituting the central tuft of the brush are all of the same length.

In order that the invention may be better understood, one example of a brush embodying the invention will now be described with reference to the accompanying drawing, in which.

The same elements are indicated by the same reference numerals in the two figures.

Figure 1:
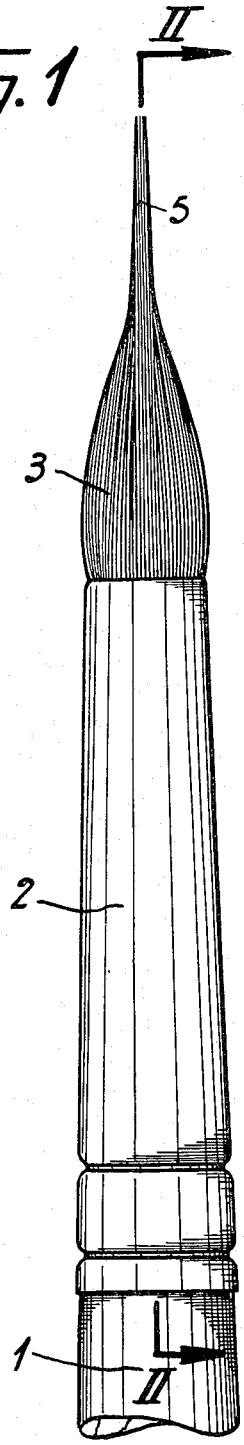
FIG. 1 is a side elevation of a linear brush according to the invention.

In the embodiment illustrated, a round brush comprises a handle 1 and a tuft of hairs 3–4–5 rigidly bound to one another by means of a ferrule 2 and an adhesive 8.

In the brush shown, the tuft of hairs 3–4 consists of two parts: a peripheral part 3, cylindrical and tapered, arranged in the standard manner, and a central part 4 distinguished in that at its end portion 5, the hairs which compose it project substantially beyond the longest hairs of the peripheral tuft 3 of hairs. The part 5 constitutes the working point of the brush.

Figure 2:
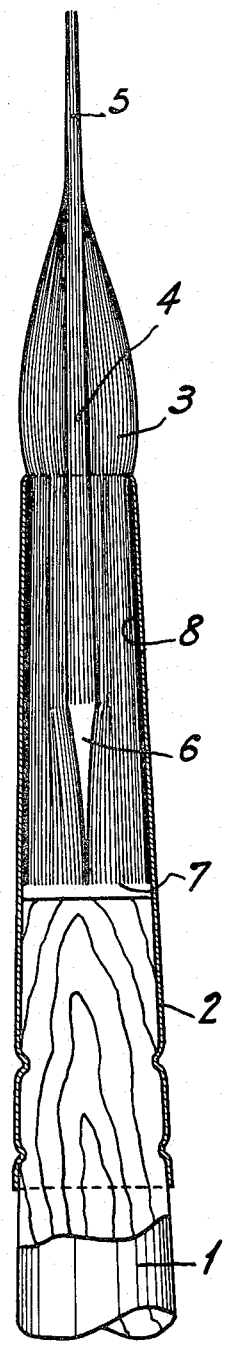
FIG. 2 is a cross section on a longitudinal plane of symmetry along the line II—II in FIG. 1.
Figure 3:
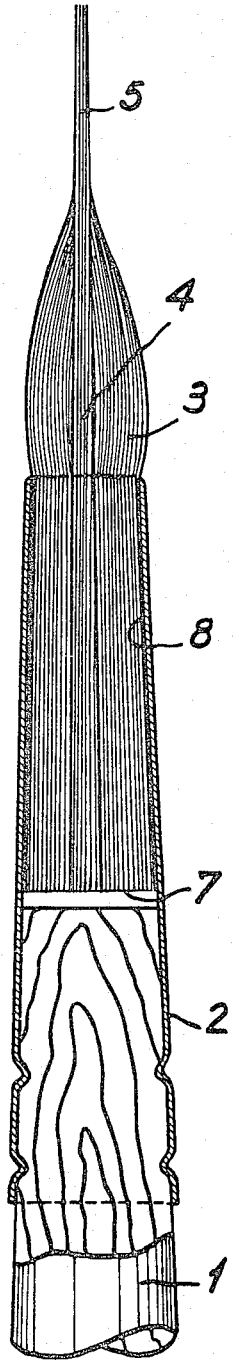
FIG. 3 is a cross section on a longitudinal plane of symmetry similar to FIG. 2 and showing a liner brush according to another embodiment of the present invention.

If the initial tuft of hairs is a cylindrical and tapered tuft, a round brush embodying the invention may be made by pulling out the central part of the initial tuft of hairs, before sticking and fixing, in such a manner that this central part projects substantially beyond the peripheral part. In this manner, a channel 6 (FIG. 2) is created, into which the liquid contained in the peripheral tuft of hairs 3 tends to flow.

It will thus be seen that in a brush embodying the invention the peripheral tuft of hairs 3 constitutes a reservoir of liquid, ink or paint, for the central part 4–5, which alone takes part in the drawing of the line, to such effect that the line can be a fine one although the round brush comprises a tuft of hairs having a large volume.

A second method of carrying the invention into effect consists in choosing a tuft of hairs 4–5 having a length substantially greater than the remainder of the cylindrical and tapered tuft 3 and in arranging this tuft of longer hairs 4–5 along the axis of symmetry of the cylindrical and tapered tuft, the opposite end of all the hairs comprising the two tufts being then in the same plane 7 inside the ferrule 2. The flow channel effect is obtained in this latter case by making the hairs constituting the central tuft 4–5 of a material different from that of the hairs comprising the peripheral tuft 3.

A brush embodying the invention undoubtedly provides a considerable advantage with respect to a standard brush not furnished with a reservoir. The tuft of peripheral hairs 3, in addition to its function as a reservoir, also constitutes a resilient support for the tuft of hairs 4–5, which effectively constitute the working part;

working with these latter hairs is thereby greatly facilitated and the quality of the work is improved.

The round brush embodying the invention thus permits a not inconsiderable saving of time and, because of its reservoir, it reduces the number of times that a user has to remove his hand from the workpiece. The continuity of the drawn line and its transverse dimension in particular are thereby greatly improved.

The hairs 3–5 may be formed of kolinsky, of calabar, of calf ear, or of a mixture of any two or three of these materials.

What we claim is:

1. A liner brush comprising a handle with a ferrule having an open end, a peripheral tuft of hairs having an inner end peripherally arranged inside of said ferrule in a first plane substantially perpendicular to the longitudinal axis of the brush and tapered outer end extending outside of the open end of said ferrule, and a central tuft of hairs of substantially lesser cross-sectional area arranged along said longitudinal axis of the brush, said central tuft having an inner end arranged inside of said ferrule in a second plane substantially perpendicular to said longitudinal axis and an outer end extending outside of the open end of said ferrule beyond the outer end of said peripheral tuft, said second plane being nearer to the open end of said ferrule than said first plane, so that a void channel is formed inside of the inner end of said peripheral tuft and adjacent said central tuft inner end for storing liquid material.

2. A liner brush according to claim 1, in which the central hairs and the peripheral hairs are of different materials.

3. A liner brush according to claim 1, in which the hairs constituting the central tuft are all of the same length.

* * * * *